United States Patent [19]

Stevenson et al.

[11] Patent Number: 4,482,268

[45] Date of Patent: Nov. 13, 1984

[54] BOAT LIFT

[75] Inventors: Ernest W. Stevenson, Danville; Randall E. Nahas, Alamo, both of Calif.

[73] Assignee: Levitator, Inc., Glenbrook, Nev.

[21] Appl. No.: 541,715

[22] Filed: Oct. 13, 1983

[51] Int. Cl.[3] ..... B63C 3/06

[52] U.S. Cl. ..... 405/3; 114/44; 405/1

[58] Field of Search ..... 405/1-7, 405/221; 114/44-49; 414/680

[56] References Cited

U.S. PATENT DOCUMENTS

| | | | |
|---|---|---|---|
| 2,536,475 | 1/1951 | Thomas | 114/45 |
| 2,536,908 | 1/1951 | Chadwick | 114/44 X |
| 2,976,694 | 3/1961 | Stanford | 405/1 |
| 3,177,668 | 4/1965 | Schneider et al. | 405/3 |
| 3,362,172 | 1/1968 | Rutter | 405/3 |
| 3,559,606 | 2/1971 | Gregory | 405/3 X |
| 3,753,355 | 8/1973 | Knoch | 405/3 |
| 4,019,212 | 4/1977 | Downer | 114/361 |
| 4,027,492 | 6/1977 | Carpenter | 405/3 |
| 4,401,335 | 8/1983 | Godbersen | 294/84 |
| 4,432,664 | 2/1984 | Baldyga | 405/3 |

*Primary Examiner*—Dennis L. Taylor
*Attorney, Agent, or Firm*—James R. Cypher

[57] ABSTRACT

A boat lift supported on a single stanchion that includes a sleeve assembly mounted for slidable movement on the stanchion. A cross arm mounted on the sleeve assembly carries fork members which protrude out from the cross member. Blocks on the forks cradle the hull of a boat for lifting. Standards mounted on the cross member carry bumper floats and docking eyes.

10 Claims, 13 Drawing Figures

BOAT LIFT

BACKGROUND OF THE INVENTION

Boat lifts as shown in U.S. Pat. Nos. 2,976,694 Stanford, 3,177,668 Schneider, 3,362,172 Rutter, 3,753,355 Knock, 4,019,212 Downer, and 4,027,492 Carpenter have been found to be inadequate to meet the needs of boat owners who wish to quickly and easily lift these boats out of the water and launch them with the same ease and speed. The need for lifting ease and speed requirements may range from simple convenience to difficult conditions induced by high waves, fast currents or heavy winds.

Further, the above lifts are capable of raising a boat only a few feet while many lakes and dams may periodically rise and fall five, ten or even fifteen or more feet due to hydroelectric power generation and re-generation by refilling the lake during off peak power generation hours. Even major lakes such as Lake Tahoe on the border of California and Nevada are subject to a 6 foot change in water level. Rivers and flood control dams or sea coast waterways subject to tides can rise and fall several feet and render all but the largest lifts useless at low water conditions.

The increase in the number of boats and the need to maintain clear channels has made it impossible in many locations to install the prior art devices which are set on the bottom of the lake or river and remain submerged in the water when not lifting a boat. Such apparatus is a hazard to other boats and cannot be used where a clear channel is required.

All of the prior art lifts except Stanford, supra require "head-in" docking as opposed to the simpler and safer "parallel to pier" docking. The Stanford pivoting boat beacher is a "walking" pier, however, as well as a lift and is in a different category from simple lifts.

Finally, probably none of the above prior patented lifts can operate in water as shallow as the lift of the present invention, with the exception of Stanford, supra which can actually be driven on its crawler wheels up onto the beach.

SUMMARY

The present boat lift provides a boat lift which can lift and launch a boat with unprecedented speed and convenience. Instead of a bothersome and sometimes dangerous and tedious chore, docking and launching is so rapidly and easily accomplished that even the most ardent and skilled boat owner will find that he uses his boat much more frequently.

Since the lift of the present invention can raise a boat fifteen (15) or more feet, expensive floating docks such as Rutter, supra are no longer required with dry docks which operate with lifting pontoons. Moreover, the present lift can be used where the water level is subject to very wide variations.

The present lift requires but a single stanchion driven into the bottom of the lake or river together with a simple lateral support. The entire lifting apparatus can be raised high above the water leaving a clear channel except for very high cabin boats or sail boats.

Docking with the present lift is accomplished parallel to the lift so that a sudden reversal of the propeller is not required at the final moment of docking. Such a procedure avoids damage to the boat, adjacent piers, and the lifting apparatus itself.

Moreover, head-in dockings in a swiftly moving river can be extremely difficult with the boat at right angles to the current. Even the most skilled helmsman is going to miss the mooring frequently. The present lift when located on a river will almost always be located on the bank or on a pier parallel to the current so that the approach to the lift can be directly into the current under power to give precise control.

Finally, the present lift can lift boats in very shallow or deep water with equal ease because of the minimum amount of apparatus between the lifting chocks and the lowermost portion of the lift. This can extend the time of launchings and liftings beyond the "high-tide" only launchings.

DESCRIPTION OF THE PREFERRED EMBODIMENTS

Figure 1:
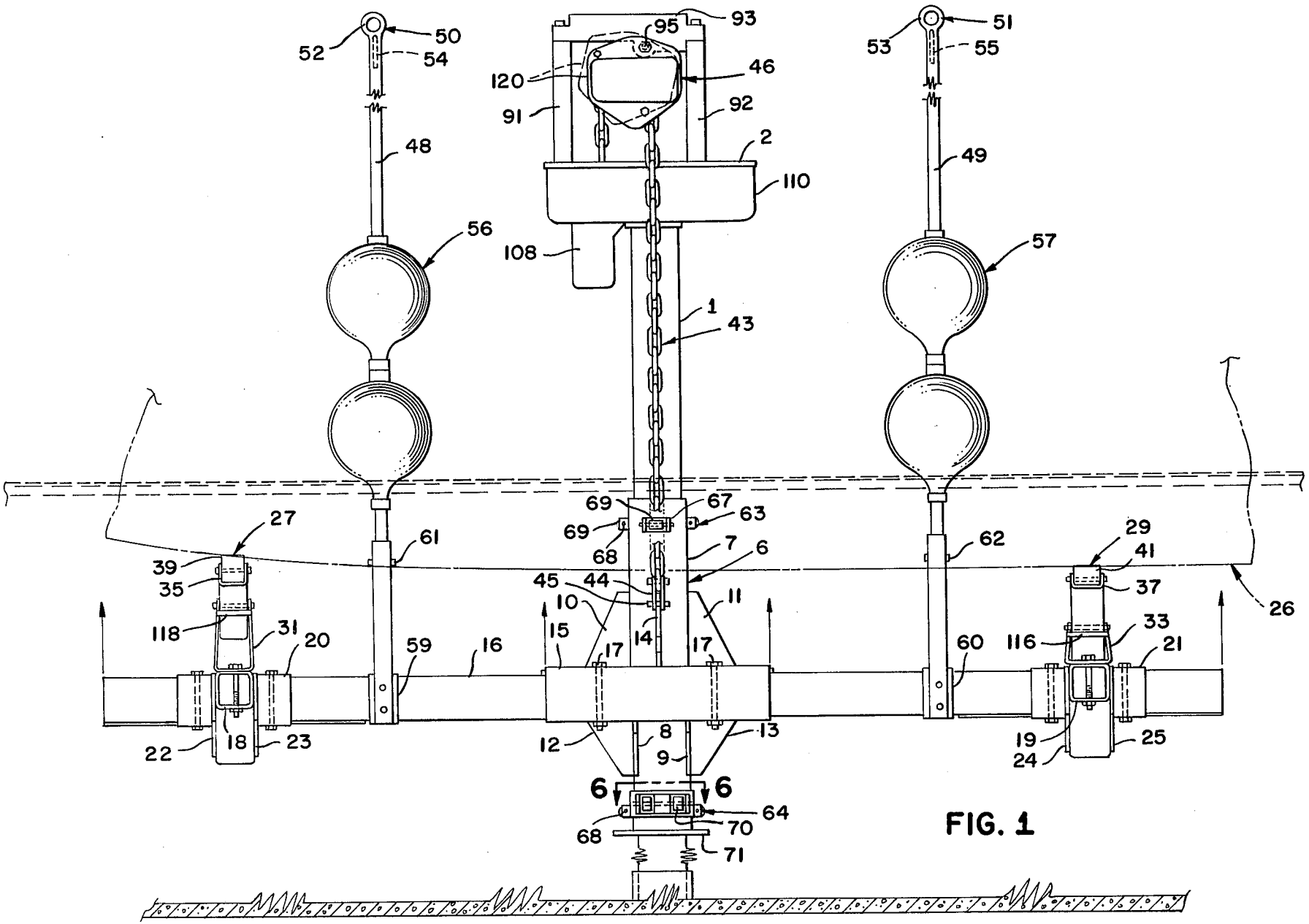
FIG. 1 is a front elevation view of the lift of the present invention. A portion of a boat resting on the apparatus is shown in phantom line. The dashed lines indicate the water surface. The lift has raised the boat only slightly.

The boat lift is supported on a single load bearing stanchion member 1 which may be a $\frac{3}{8}''$ wall 5" by 5" square tube. A base plate 2 of considerable rigidity, such as a $\frac{1}{2}''$ steel plate is seated on the top of the stanchion and suitably braced. A bracket member 3 is connected to the base plate laterally disposed from the stanchion member and is adapted for connection to a stabilizing member 4. The size and configuration of the bracket will depend upon whether the stanchion is to be stablized by an existing pier 5 or by another member 4 driven into the lake or river bottom. The stabilizing bracket must also be engineered, depending upon the stability of the stanchion to resist lateral forces. In some instances the stanchion will be driven into the lake or stream bottom while in other installations it may be anchored in a foundation.

A sleeve assembly 6 is slidably mounted on the stanchion member for travel thereon. The sleeve assembly here consists of an inner sleeve 7 which surrounds the stanchion and is constructed from ⅜" wall tube 6"×6"×4' and distributes the moment load on the stanchion. Lower braces 8 and 9 and side braces 10, 11, 12 and 13 and lifting flange 14 are welded to the inner sleeve and to cross bar sleeve 15. The cross bar sleeve holds a cross arm member 16 which may be constructed from ⅜" wall steel tube 5"×5" with a length of 10' and extends laterally substantially equidistant on either side of the stanchion. Preferably, the cross arm is mounted on the cross bar sleeve for sliding movement. Pins or bolts 17 secure the cross arm to the cross bar sleeve after the cross arm has been positioned. The adjustable cross bar is to insure that the load is evenly distributed with respect to the stanchion to reduce twisting of the cross bar sleeve and imparting a moment load to the stanchion. Heavy outboard motor boats for example carry their weight at the stern as opposed to inboard boats which shift the center of gravity further forward. The adjustable feature is also important with heavy keel boats.

A pair of fork members 18 and 19 are connected to the cross arm on opposite sides of the stanchion member. The forks may be ⅜"×4"×4" tube ×6'6" and are preferably connected to fork sleeves 20 and 21 which are slidably mounted on cross arm 16. The slideable forks are the primary means of adjustment to ensure that the center of gravity of the boat is as close to the centerline of the stanchion as possible. To enable the boat lift to raise boats in as shallow water as possible, the fork members are mounted below the cross arm and connected to the fork sleeves by braces 22, 23, 24 and 25.

Block means are mounted on the fork members for cradling the hull 26 of a boat. The block means here consist of fore block assemblies 27 and 28 connected to fork member 18 and aft block assemblies 29 and 30 connected to the aft fork member 19. The fore block assembly includes right and left swivel mounts 31 and 32 connected to the fore fork member and the aft block assembly includes right and left swivel mounts 33 and 34 connected to the aft fork member. Fore boat blocks 35 and 36 are pivotally mounted on the fore swivel mounts and aft boat blocks 37 and 38 are pivotally mounted on the aft swivel mounts. The boat blocks may be constructed from channel members in which yieldable blocks of rubber or foam plastic 39, 40, 41 and 42 may be inserted to protect the hull of the boat during lifting. The fore swivel mounts may be constructed with a higher dimension to accommodate sail boats or ocean racing boats having a steeply curving "V" configuration.

Figure 2:
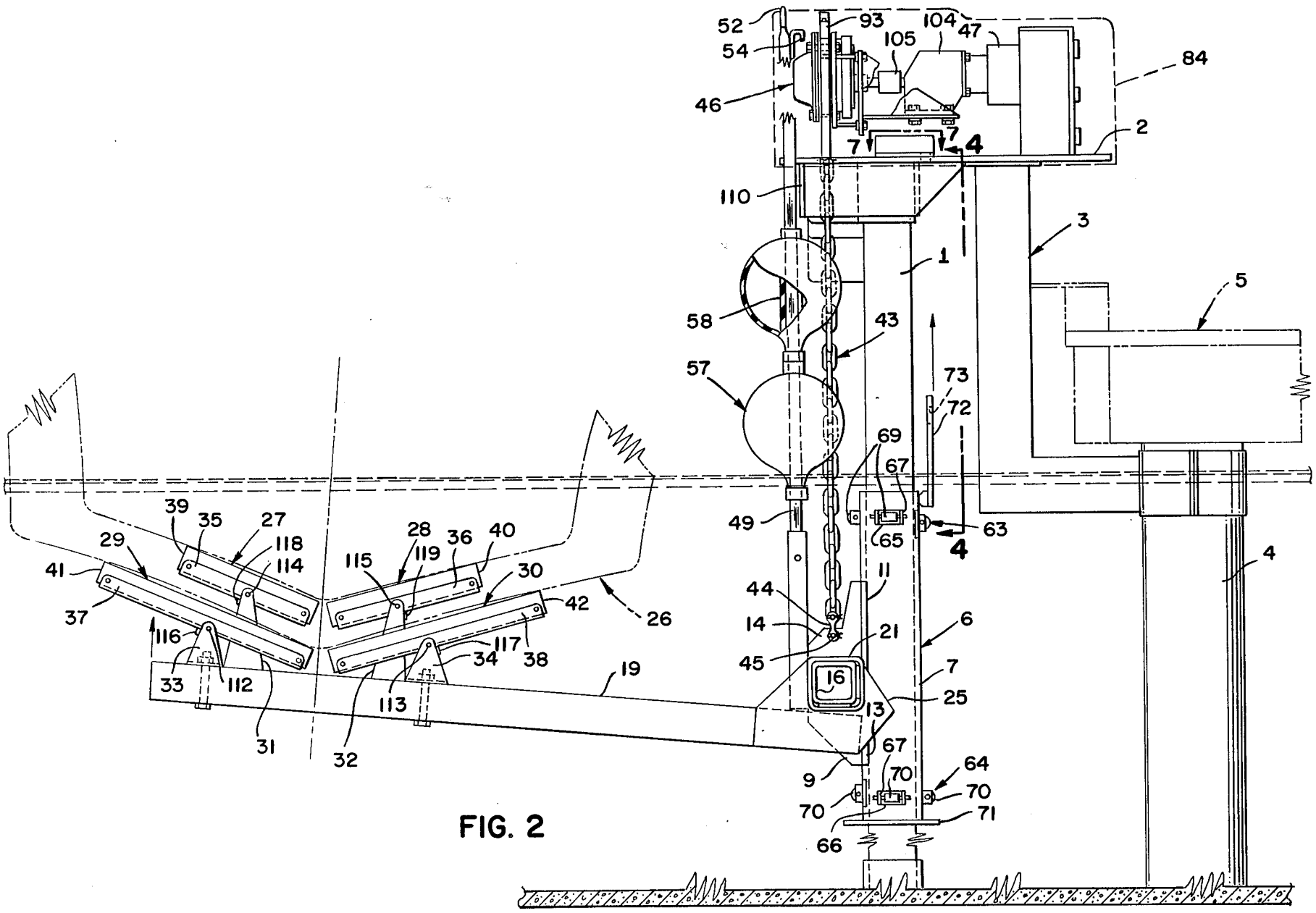
FIG. 2 is a side elevation view of the lift shown in FIG. 1 with portions of the same boat hull in phantom line.
Figure 3:
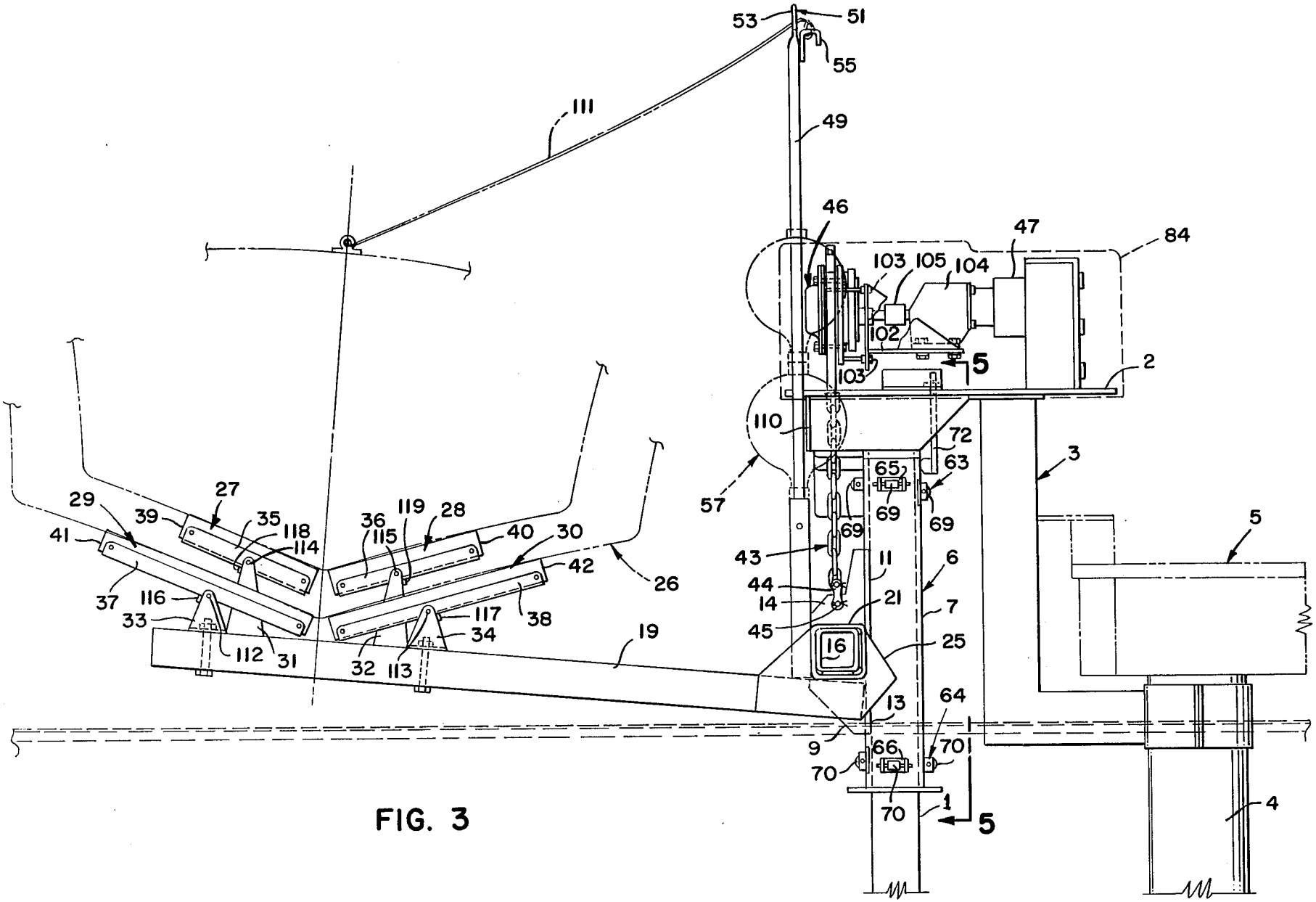
FIG. 3 is another side elevation view identical to FIG. 2 except that the boat has been raised above the water and the lift is in its upper latched and secure position.

As shown in FIG. 2, the blocks are mounted on the swivel mounts by pivot pins 112, 113, 114 and 115. The blocks are mounted so that the pivot points are off center and when there is no boat on the blocks they will rotate until they strike stops 116, 117, 118 and 119. The stops are mounted so that the blocks will be stopped at a level position. As the hull of the boat is cradled by the blocks, they rotate until they conform to the hull of the boat.

A lifting member 43 is connected to the sleeve assembly 6 and may be a cable or preferably a chain. The chain may be attached to a coupling 44 which is connected to a pin 45 inserted through an opening in lifting flange 14.

The chain is operatively connected to a mechanical multiplying means 46 which preferably is a chain fall. No special chain fall is required and the chain fall here shown is a 3 ton rated chain fall manufactured by Ratcliff in Redwood City, Calif.

The chain fall may be hand operated, but preferably a power means 47 is connected to the chain fall. The power means may be an internal combustion engine but where electrical power is available, a ¾ horsepower electrical motor may be used. The motor can drive the chain fall so that the lift travel is approximately 4 feet per minute. To assist in docking and to secure the boat to the lift, a pair of docking standards 48 and 49 are connected to the cross arm on opposite sides of the stanchion member. Docking eye members 50 and 51 are mounted at the upper end of each docking standard and here consist of circular members 52 and 53 through which the line is inserted and a downwardly extending hooks 54 and 55 to which the looped line is affixed.

A unique feature of the lift is the use of buoyant fender means 56 and 57 which are slidably mounted on each of the docking standards and move upwardly or downwardly with the raising or lifting of the lift or the rising and falling water level. This feature always insures that the fenders will be at the proper elevation for protecting the boat from coming in contact with the metal standards. The fenders may be spheres or cylinders with inner sleeves 58 as shown in FIG. 2.

Another feature of the lift is the fact that the standards may be slidably mounted on the cross arm member to accomodate boats of different lengths. As shown in the drawings, docking eye sleeves 59 and 60 are slidably attached to the cross arm and the standards are mounted thereon. Set screw means 61 and 62 may be provided on the docking eye sleeves to releasably secure the standards.

Figure 6:
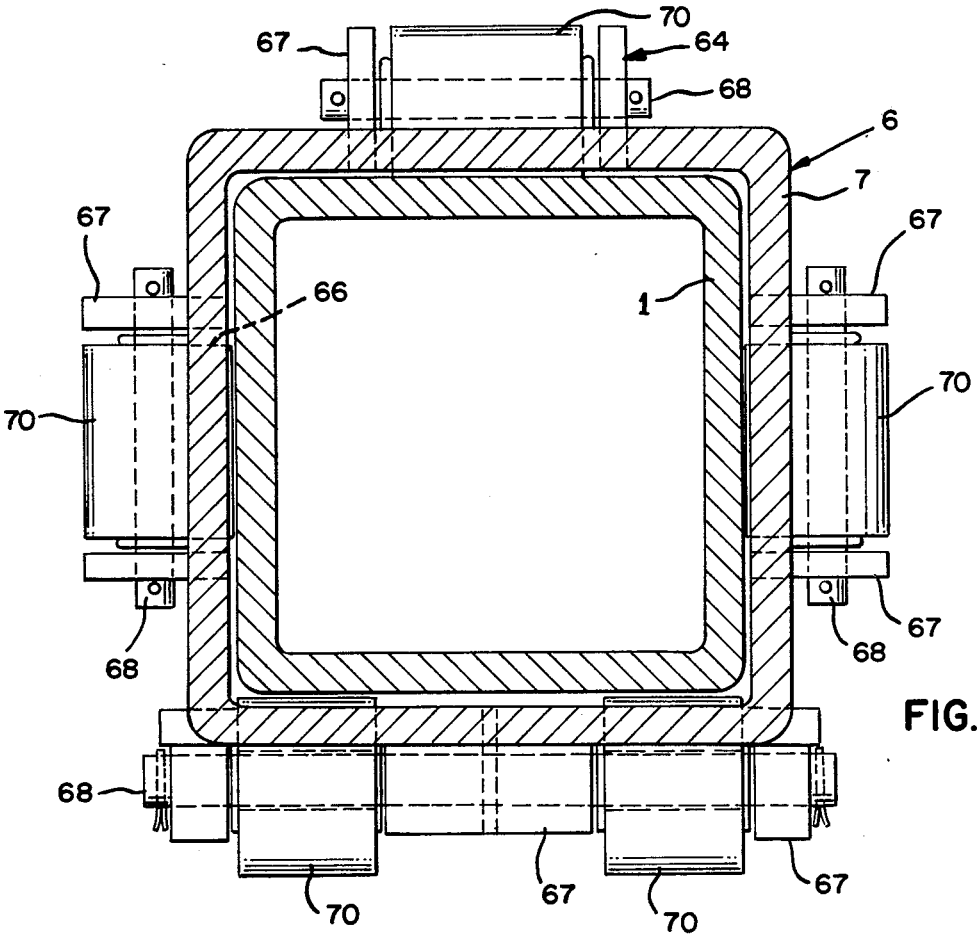
FIG. 6 is an enlarged cross sectional view taken along line 6—6 of FIG. 1.
Figure 4:
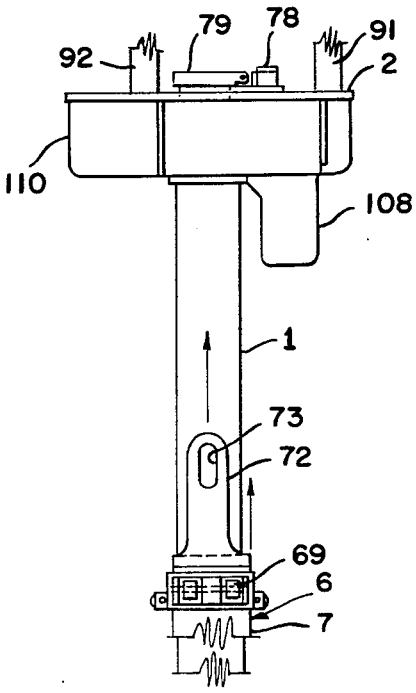
FIG. 4 is a rear elevation view of a portion of the lift in the partially raised position.
Figure 5:
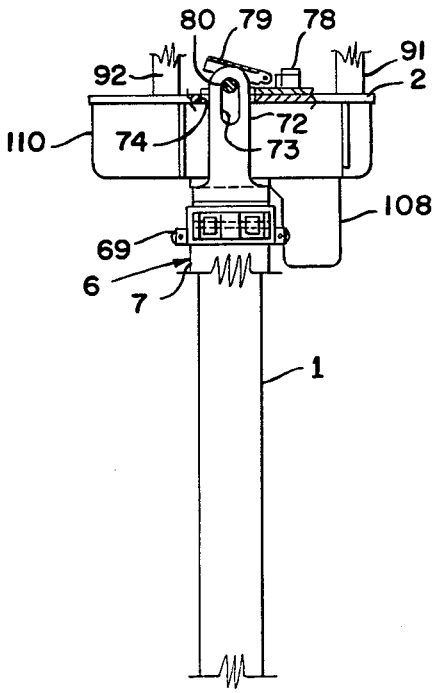
FIG. 5 is a rear elevation view identical to FIG. 4 except that the lift is in the upper latched and secure position.
Figure 7:
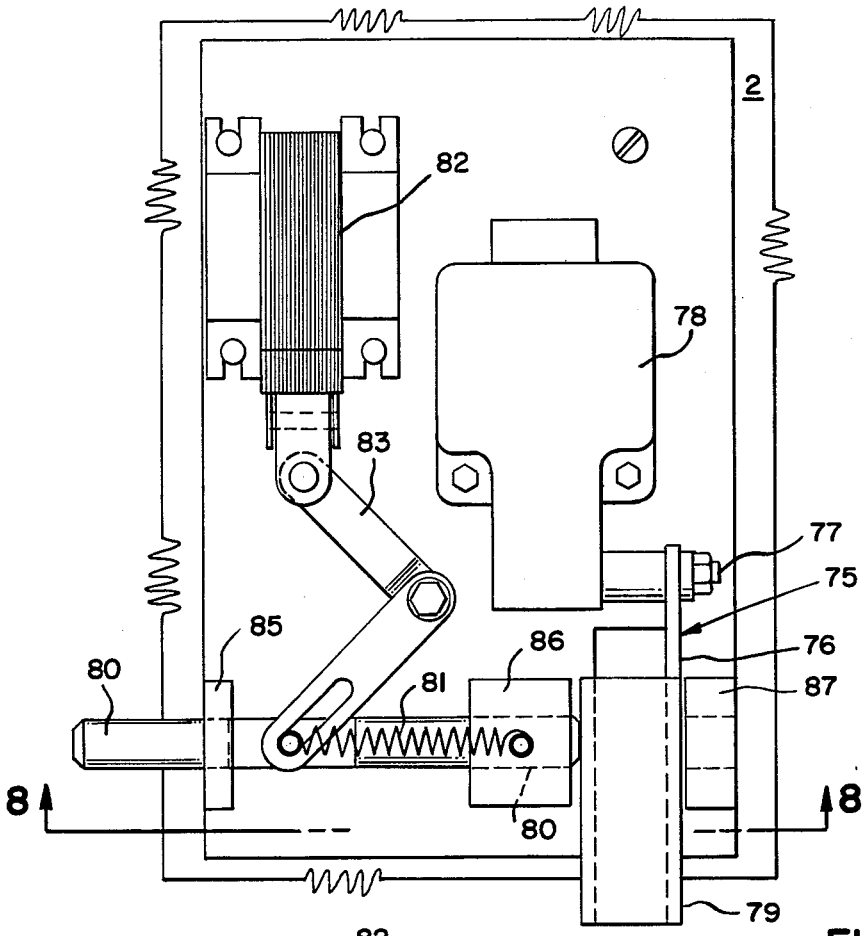
FIG. 7 is a plan view of a latching mechanism for the lift taken in the vicinity of line 7—7 of FIG. 2.
Figure 8:
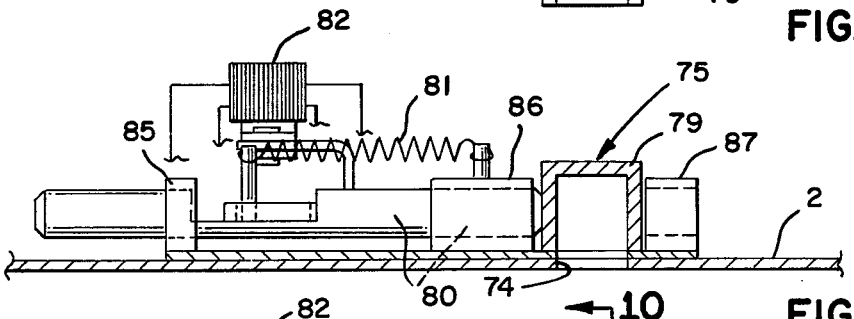
FIG. 8 is a side elevation of the latch mechanism taken along line 8—8 of FIG. 7 with the pin in the retracted position.
Figure 9:
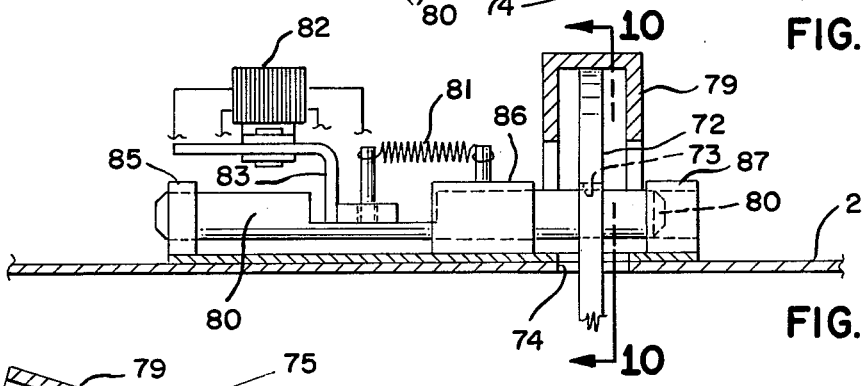
FIG. 9 is identical to FIG. 8 with the pin in the latched position.
Figure 10:
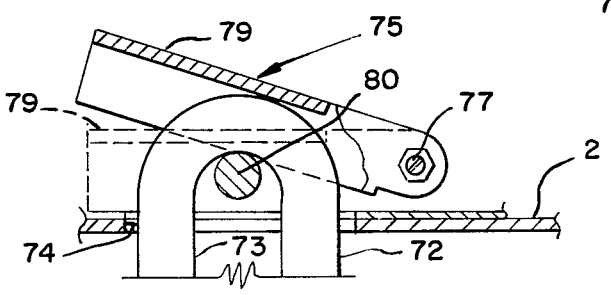
FIG. 10 is an enlarged partial view of the latch mechanism taken along line 10—10 of FIG. 9.
Figure 11:
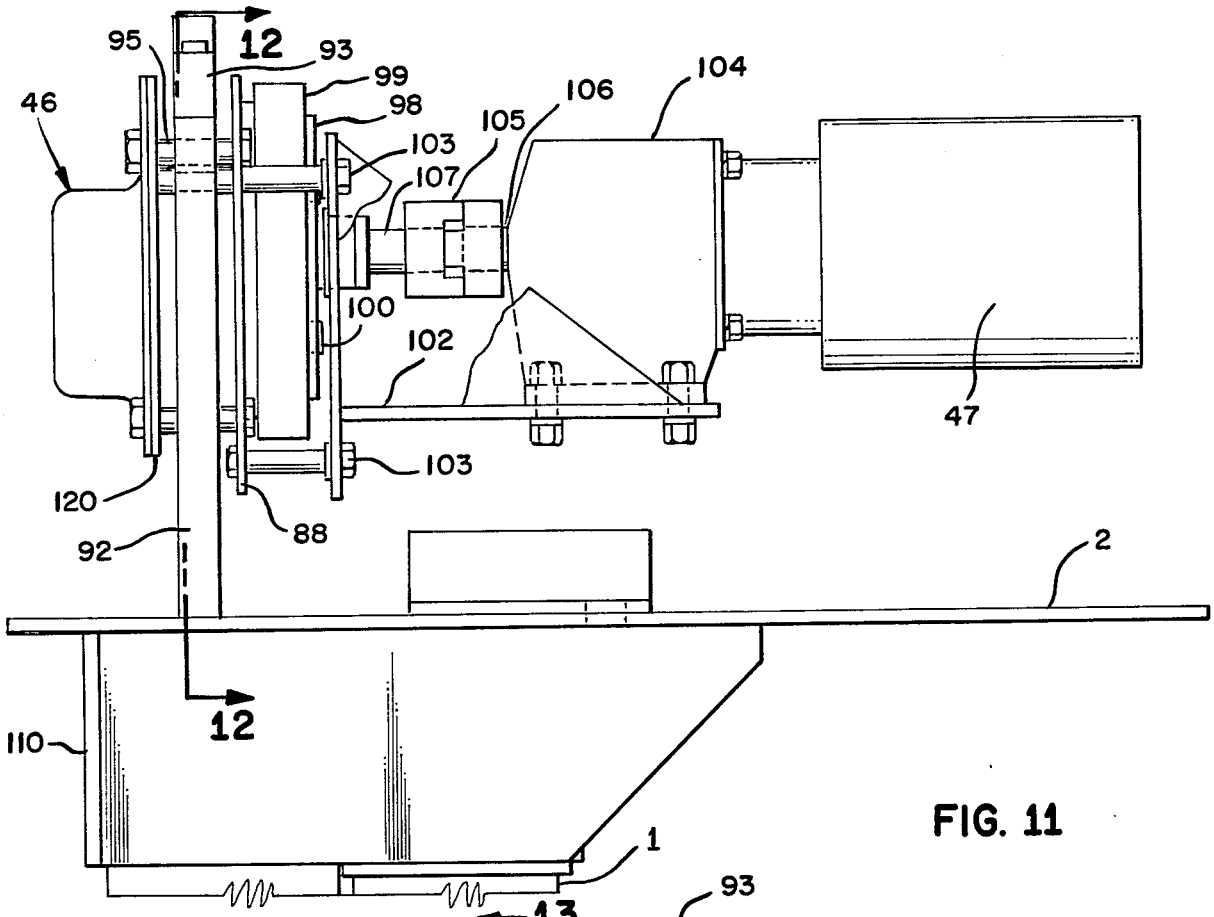
FIG. 11 is an enlarged side elevation view of a portion of the lift specifically illustrating the motor driven chain lift.

To insure free travel of the sleeve assembly 6 on the stachion, upper and lower rollers assemblies 63 and 64 are mounted on the sleeve assembly for rolling contact on the stanchion member as shown in FIG. 6. In the illustration, the stanchion inner sleeve is formed with upper side cutouts 65 and lower side cutouts 66. Guide roller blocks 67 are welded to the inner sleeve adjacent the openings and are formed with openings for holding the roller shafts 68 which hold upper guide rollers 69 and lower guide rollers 70. Since the guide rollers ride all four sides of the stanchion, the loads on the forks need not be perfectly balanced.

A bottom plate 71 welded to the inner sleeve lower end limits the lowermost movement of the inner sleeve, and prevents the inner sleeve from penetrating channel bottom silts.

The use of a chain hoist, also referred to as a chain fall, provides automatic ratcheting of every point of elevation of the lift. The lift will hold at any position between fully down and fully up positioning. A safety latch, however, is preferably provided at the uppermost position. In addition, the automatic latching can provide a locking mechanism to prevent unauthorized use of the lift. An eye member 72 is connected to the inner sleeve member adjacent the upper end with a slotted opening 73 therein. An opening 74 is provided to the base plate for registration of the eye member therethrough. The latch means 75 is mounted on the base plate 2 and consists of a switch arm 76 which is pivotally mounted on switch pin 77. As switch arm 76 is raised by the movement of the eye member 72 through the opening in the base plate, the switch arm 76 rotates and activates switch 78 which cuts off the power to motor 47 thereby stopping the raising of the lift. At the same time, the lifting of the channel shaped member 79 on switch arm 76 releases latch pin 80 which is biased to a latching position by spring 81 and slides in pin guides 85, 86 and 87. The latching pin moves through the opening 73 in eye member 72 and the lift is securely latched from downward movement. To release latching pin 80, it is necessary to electrically activate solenoid 82 which rotates bell crank 83 and withdraws the latching pin from its latched position. When the lift is actuated to move downwardly, channel shaped member 79 is once again permitted to fall by gravity to a horizontal position blocking the full return of latch pin 80 to a latched position. The entire power means and latch means may be covered by a locked cover 84.

Figure 12:
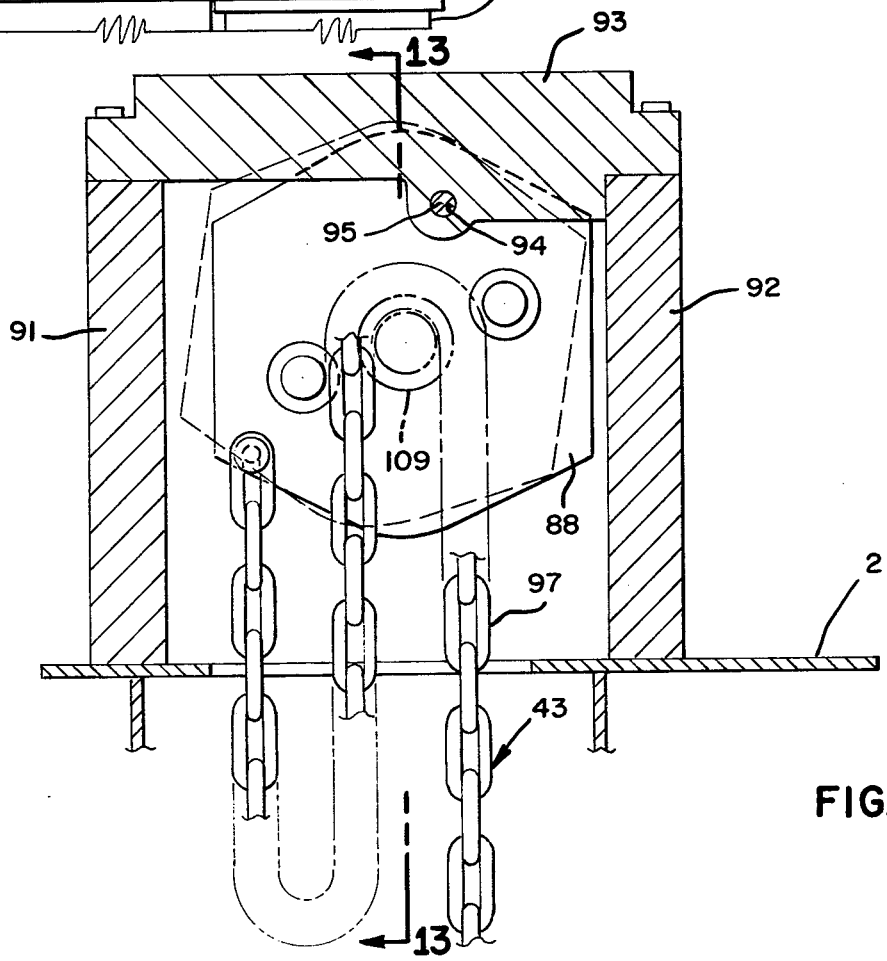
FIG. 12 is a cross sectional view of a portion of the chain lift and mounting taken along line 12—12 of FIG. 11.

Chain falls are commonly used in industrial plants for lifting equipment and materials. In all instances known to Applicants, however, the chain falls is supported by a hook to a rigid member. In such installations, the hook permits the chain fall to be swiveled 360° and to pivot. Applicants found, however, that when a standard chain hoist was mounted on a fixed mounting, it would not operate. For this reason, Applicants constructed a yoke type structure consisting of yoke legs 91 and 92, and yoke cross member 93. A pivot opening 94 is provided in the yoke cross member and a pin 95 pivotally connects the chain hoist 46 to the yoke cross member 93. Thus, depending on the load, the chain hoist pivots so that the lifting portion 97 of chain 43 is slightly outwardly of pivot pin 95 as shown in FIG. 12. The solid lines of plates 88 and 120 show the position of the chain fall without load. The dashed lines 88 and 120 show the position of the chain fall and plates under load.

Figure 13:
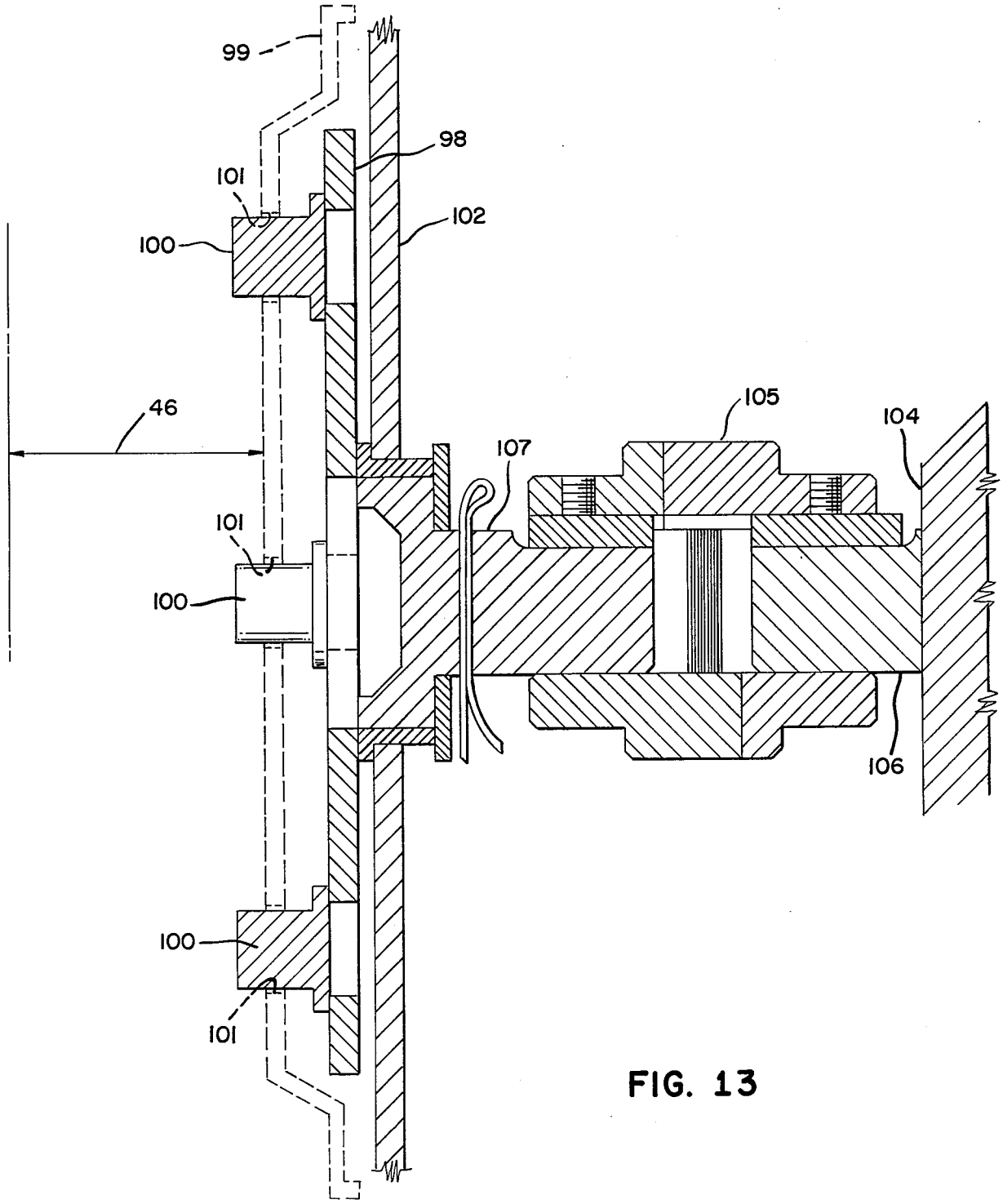
FIG. 13 is an enlarged cross section of a portion of the chain lift taken along line 13—13 of FIG. 12—12.

Applicants found that a standard chain operated chain hoist was too slow and inconvenient for many persons with power boats. A standard hand operated chain hoist is used with the following modifications as shown in FIG. 13. The hand operated chain is removed and an adapter wheel 98 is mounted adjacent the hand operated chain wheel 99. A plurality of studs 100 are welded to the adapter wheel and the studs engage openings 101 in the hand chain wheel 99. A cradle 102 is connected to plate 88 of the chain hoist by bolts 103. An electric motor 47 and gear reducer 104 are mounted on cradle 102. Coupling 105 connects the gear reducer shaft 106 to the shaft 107 connected to the adapter wheel 98. It is understood that the cradle 102 with the electric motor, gear reducer coupling, shaft and adapter wheel all pivot with the chain hoist as load is imposed by the lifting chain about pin 95.

A chain bucket 108 is attached beneath the base plate and the chain hoist to receive and store the chain as it comes off the chain lifting wheel 109. Appropriate guides within the chain bucket ensure proper entry of the chain into the bucket and withdrawal when the lift is lowered.

As presently constructed, the lift is not cleared for lifting passengers as well as the boat. Should a boat owner or children remain in the boat, however, Applicants have provided metal guard plates 110 which encircle the base plate at the point of entry of the lifting chain. Should a person hold onto the lifting chain while the lift is being raised, his arm will bump against the metal guard plates and warn him to release his grip on the chain before it wraps around the chain wheel. Where the guard plates are made of substantial thickness, they also serve to stiffen the base plate and prevent it from warping under heavy loads.

Docking of a boat on the lift is simple and by following the steps set forth below, the boat automatically centers itself in the correct position for lifting. First, the fork members are adjustably slid along the cross arm so that the center of gravity will be in close alignment with the stanchion member. The docking standards are then slid along the cross arm until they are in convenient position for attaching bow and stern lines 111.

The lift is now lowered to a position so that the hull will clear the block means. The boat is then maneuvered into the correct position on the block means for lifting by use of the motor in the boat or by hand. The bow and stern lines are attached to the docking eyes on the standards and shortened until they securely hold the boat to the docking standards. The lift motor is now actuated and the boat is lifted out of the water.

The next time the boat is docked, it is simply necessary to lower the forks into the water. The buoyant fenders rise on the standard and provide a large visual reference for docking. The bow and stern lines are now attached to the docking eyes on the standards. Since the docking eyes are several inches lower than their normal position with respect to the boat, the lines will have slack in them for easy attachment to the docking eyes. As the electric motor of the lift is operated, the standards will rise along with the forks and cross arms, and the bow and stern lines will pull the boat into a centered position with respect to the chocks. As the lift continues to rise, the block means will engage the bottom of the hull and lift the boat out of the water. The bow and stern lines will now be taut and securely hold the boat. The buoyant fenders will remain in engagement with the sides of the boat and be in position with respect to the boat when the boat is once again lowered into the water so that the boat sides do not come in contact with the stanchion or the metal standards. The boat may be lifted to any height and the ratchet mechanism of the chain lift will hold the boat so that it may be inspected, the hull cleaned, work done on the motor, or for any other purpose. The boat may be lifted to the upper limit as previously explained and latched and locked until ready for use once again.

When the lift is provided with an electric motor, a remote control unit can be attached to the base plate and a control unit similar to the electric control unit on a garage door opener can be used to operate the lift. Thus, when the boat is in the lifted position, a person with the remote controller can activate the motor to lower the boat even though he is still several yards from the boat. When he arrives at the boat, the boat will be floating in the water. He merely needs to cast off the bow and stern lines and power or sail away from the lift. Once clear of the lift, with his remote controller, and while still in the boat, he can cause the lift to be raised to its upper position free of the channel.

In returning to the lift, again, before reaching the lift, the remote controller can signal the latching mechanism to unlatch the latching pin and for the electric motor to lower the forks into the water. As the boat approaches, any changes in the level of the water can be noted and the forks lowered to the approximately correct depth for lifting. If the bow and stern lines cannot be easily slipped into the docking eyes, the operator knows that the forks should be lowered still further. Once the lines are secured to the docking eyes, the captain and passengers can disembark and then once out of the boat, the controller can be actuated and the boat lifted out of the water.

The swivel block height should be selected so that the boat tilts slightly in the direction of the drain valve. Thus as the boat is lifted, the bilge will drain while the boat is stored. It is also recommended that the boat either be covered or the drain valve be opened so that rainwater caught by the boat during storage will drain.

The lift may be outfitted with lights so that when the boat approaches the lift at night the boat can be easily positioned in relation to the forks.

The use of a remote control device to operate the electric motor of the lift permits the boat operator to stay in the boat while operating the lift in the docking operation. Thus, when the lines have been secured to the docking eyes, the remote controller can signal the lift to be raised until the boat is resting on the boat blocks. While the boat operator and passengers are still in the boat, the remote controller can signal the motor to raise the lift a few inches until the boat is stable on the lift. The operator and passengers can then leave the boat from a stable platform rather than from a floating boat. A cover can then be placed over the boat if necessary, while the boat is a stable secure position. The boat may now be raised to its upper position by the remote controller from the safety of the dock.

We claim:

1. A boat lift comprising:

(a) a single stanchion load bearing member;

(b) a base plate connected to the top of said stanchion;

(c) a bracket member connected to said base plate laterally disposed from said stanchion members and adapted for connection to a stablizing member;

(d) a sleeve assembly slidably mounted on said stanchion member for travel thereon;

(e) a cross arm connected to said sleeve assembly and extending laterally substantially equidistant on either side of said stanchion;

(f) forward and aft fork members connected to said cross arm and disposed on opposite sides of said stanchion member;

(g) block means mounted on said forks adapted for cradling the hull of a boat;

(h) a lifting member connected to said sleeve assembly; and (i) mechanical multiplying means connected to said lifting member.

2. A boat lift as described in claim 1 comprising:

(a) a pair of docking standards connected to said cross arm on opposite sides of said stanchion member;

(b) docking eyes mounted at the upper end of each of said docking standards; and (c) buoyant fender means slidably mounted on each of said docking standards for vertical free sliding movement.

3. A boat lift as described in claim 1 comprising;

(a) said block means includes a fore block assembly connected to said fore fork member and an aft block assembly connected to said aft fork member;

(b) said fore block assembly includes right and left swivel mounts connected to said fore fork member;

(c) said aft block assembly includes right and left swivel mounts connected to said aft fork member; and (d) power means connected to said mechanical multiplying means.

4. A boat lift as described in claim 1 wherein:

(a) said fork members include slide means slidably mounted on said cross arm.

5. A boat lift as described in claim 2 wherein:

(a) said docking standards include slide means slidably mounted on said cross arm.

6. A boat lift as described in claim 1 wherein:

(a) said sleeve assembly includes upper and lower roller assemblies mounted for rolling contact on said stanchion member.

7. A boat lift as described in claim 1 comprising:

(a) a latch means mounted on said base plate;

(b) an eye member mounted on said sleeve member and positioned for releasable registration with said latch means.

8. A boat lift as described in claim 1 comprising:

(a) said lifting means is a linked chain; and (b) said mechanical multiplying means is a chain fall.

9. A boat lift as described in claim 8 comprising:

(a) a yoke member connected to said base plate;

(b) said chain fall is pivotally connected to said yoke member;

(c) said chain fall includes a chain drive power wheel;

(d) an adapter member connected to said power wheel; and (e) an electric motor operatively connected to said adapter member.

10. A boat lift as described in claim 1 comprising:

(a) said sleeve assembly includes a cross bar sleeve; and (b) said cross arm is slidably mounted within said cross bar sleeve.

* * * * *

UNITED STATES PATENT OFFICE

CERTIFICATE OF CORRECTION

PATENT NO. : 4,482,268

DATED : November 13, 1984

INVENTOR(S) : Ernest W. Stevenson and Randall E. Nahas

It is certified that error appears in the above-identified patent and that said Letters Patent are hereby corrected as shown below:

In Column 7, line 25, after "the boat is" insert --- in ---

In Column 7, line 35, after "stanchion" delete "members" and insert --- member ---

Signed and Sealed this

*Twenty-third* Day of *April 1985*

[SEAL]

*Attest:*

DONALD J. QUIGG

*Attesting Officer*

*Acting Commissioner of Patents and Trademarks*